US006836261B1

(12) United States Patent
Kishi et al.

(10) Patent No.: US 6,836,261 B1
(45) Date of Patent: Dec. 28, 2004

(54) PLASMA DISPLAY DRIVING METHOD AND APPARATUS

(75) Inventors: Tomokatsu Kishi, Kawasaki (JP); Kouichirou Uchiyama, Kawasaki (JP); Keishin Nagaoka, Kawasaki (JP); Takahiro Takamori, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 09/440,704

(22) Filed: Nov. 16, 1999

(30) Foreign Application Priority Data

Apr. 21, 1999 (JP) ..... 11-113773

(51) Int. Cl.[7] ..... G09G 3/28
(52) U.S. Cl. ..... 345/60; 315/169.4
(58) Field of Search ..... 345/60–72, 204, 345/208, 210–215; 315/169.1, 169.4; 348/797; G09G 3/28

(56) References Cited

U.S. PATENT DOCUMENTS 5,745,086 A * 4/1998 Weber ..... 345/63
5,877,734 A 3/1999 Amemiya
5,982,344 A * 11/1999 Tokunaga ..... 345/67
6,034,482 A * 3/2000 Kanazawa et al. ..... 315/169.4
6,211,865 B1 * 4/2001 Hosoi et al. ..... 345/204
6,323,830 B1 11/2001 Huang

FOREIGN PATENT DOCUMENTS

| | | | | |
|---|---|---|---|---|
| EP | 0 782 167 A2 | | 7/1997 | |
| EP | 0 903 719 A2 | | 3/1999 | |
| JP | 5-313598 | | 11/1993 | |
| JP | 7-175438 | | 7/1995 | |
| JP | 9-237580 | | 9/1997 | |
| JP | 10003281 A | * | 1/1998 | ..... G09G/3/28 |
| JP | 11-133913 | | 5/1999 | |
| JP | 11209040 A | * | 9/1999 | ..... G09G/3/28 |

* cited by examiner

*Primary Examiner*—Alexander Eisen
(74) *Attorney, Agent, or Firm*—Staas & Halsey LLP

(57) ABSTRACT

In a reset period after a sustain discharge period, erase discharges are done by applying pulse voltages having different waveforms in the first erase discharge period for an ON cell turned on in the preceding sustain discharge period and in the second erase discharge period even for an OFF cell not turned on in the preceding sustain discharge period. Weak wall charges that could not completely be erased in the first erase discharge period, i.e., weak wall charges having been accumulated in the OFF cell under the influence of the ON cell can be erased in the second erase discharge period. This makes it possible to prevent an ON operation of the OFF cell that should not be turned on in the subsequent address period and sustain discharge period, and to improve the driving voltage margin.

16 Claims, 10 Drawing Sheets

PDP DRIVING WAVEFORM IN EMBODIMENT

AC DRIVING TYPE PLASMA DISPLAY APPARATUS

SECTIONAL STRUCTURE OF CELL

CONVENTIONAL SUBFIELD STRUCTURE

WAVEFORM CHART SHOWING EXAMPLE OF PDP DRIVING METHOD

CHARGE ACCUMULATION STATE

CHARGE ACCUMULATION STATE IN ADDRESS PERIOD

SUBFIELD STRUCTURE IN EMBODIMENT

PDP DRIVING WAVEFORM IN EMBODIMENT

ILLUSTRATION FOR VARIABLE Vax

HARDWARE ARRANGEMENT FOR VARIABLE Vax

CHARGE ACCUMULATION STATE IN EMBODIMENT

<END OF SUSTAIN>

<ERASE>

ANOTHER EXAMPLE OF PDP DRIVING WAVEFORM

ANOTHER EXAMPLE OF RISE TIMING OF SECOND POSITIVE OBTUSE WAVE

PLASMA DISPLAY DRIVING METHOD AND APPARATUS

BACKGROUND OF THE INVENTION

1. Field of the Invention

The present invention relates to an AC driving type plasma display driving method and apparatus.

2. Description of the Related Art

In recent years, plasma display panels (PDPs) have received a great deal of attention as a next-generation display device in place of CRTs because the PDPs are self-emission type display devices with good visibility, and can realize a low-profile large-screen display. In particular, an AC driving type PDP that can realize a large screen, is expected as a display device coping with high-quality digital broadcasting, and is demanded to attain higher image quality than the CRT.

FIG. 1 is a circuit diagram showing the whole arrangement of an AC driving type PDP apparatus. In FIG. 1, an AC driving type PDP 1 comprises scanning electrodes Y1 to Yn and common electrodes X parallel to each other on one surface, and address electrodes A1 to Am perpendicular to these electrodes Y1 to Yn and X on the opposing surface. The common electrodes X are laid out close to the scanning electrodes Y1 to Yn in correspondence with them, and have terminals commonly connected.

The common terminal of the common electrodes X is connected to the output terminal of an X driver 2, the scanning electrodes Y1 to Yn are connected to the output terminals of a Y driver 3, and the address electrodes A1 to Am are connected to the output terminals of an address driver 4. The X driver 2, Y driver 3, and address driver 4 are controlled by control signals from a controller 5.

The controller 5 generates the control signals on the basis of external display data D, clock CLK indicating the read timing of the display data D, horizontal sync signal HS, and vertical sync signal VS, and supplies the control signals to the X driver 2, Y driver 3, and address driver 4.

FIG. 2 is a sectional view showing the structure of a cell Cij as one pixel on the i-th row and j-th column. In FIG. 2, a common electrode X and a scanning electrode Yi are formed on a front glass substrate 11. The common electrode X and scanning electrode Yi are covered with a dielectric layer 12 for insulating them from a discharge space 17, and the dielectric layer 12 is covered with a MgO (magnesium oxide) protective film 13.

An address electrode Aj is formed on a rear glass substrate 14 facing the front glass substrate 11, and covered with a phosphor 15. Ribs 16 for preventing color mixing between cells and maintaining a discharge gap are formed at pixel boundaries on the rear glass substrate 14 and address electrode Aj. Ne+Xe Penning gas is sealed in the discharge space 17 between the MgO protective film 13 and phosphor 15.

FIG. 3 is a voltage waveform chart showing an example of an AC driving type PDP driving method. FIG. 3 shows one of the subfields constituting one frame. Each subfield is divided into a reset period comprising a full-surface write period and full-surface erase period, address period, and sustain discharge period.

In the reset period, all scanning electrodes Y1 to Yn change to the ground level (0 V). At the same time, a full-surface write pulse of a voltage Vs+Vw (about 330 V) is applied to the common electrode X. At this time, all address electrodes A1 to Am are at a potential Vaw (about 100 V). As a result, all cells on all display lines discharge to generate wall charges regardless of the preceding display state.

The potentials of the common electrode X and address electrodes A1 to Am change to 0 V, and the voltages of wall charges themselves exceed the discharge start voltage in all cells to start discharging. During this discharge, since the electrodes do not have any potential difference, no wall charge is generated so that space charges self-neutralize to stop discharging. This is so-called self-erase discharge. This self-erase discharge makes all cells in the panel uniform freely from any wall charge. In this reset period, all cells can be made uniform regardless of the ON state of each cell in the preceding subfield. Thus, the next address (write) discharge can be stably performed.

In the address period, address discharges are done line-sequentially in order to turn each cell on/off in accordance with display data. More specifically, a scan pulse of −Vy level (about −150 V) is applied to the scanning electrode Y1 corresponding to the first display line. At the same time, an address pulse of a voltage Va (about 50 V) is selectively applied to a cell that causes sustain discharge among the address electrodes A1 to Am, i.e., the address electrode Aj corresponding to a cell to be turned on.

Consequently, a discharge occurs between the address electrode Aj and scanning electrode Y1 of the cell to be turned on. Using this discharge as a priming effect (firing), the common electrode X of a voltage Vx (about 50 V) and scanning electrode Y1 immediately discharge. Then, a sufficient amount of wall charges for the next sustain discharge are accumulated in the MgO protective film 13 on the common electrode X and scanning electrode Y1 of the selected cell. The same processing is done for the scanning electrodes Y2 to Yn corresponding to the other display lines, and new display data are written in all display lines.

In the sustain discharge period, a sustain pulse of a voltage Vs (about 180 V) is alternately applied to the scanning electrodes Y1 to Yn and common electrode X to perform sustain discharges so as to achieve a video display of one subfield. Note that the length of the sustain discharge period, i.e., the number of sustain pulses determine the video luminance.

In the above driving method, each subfield in one frame has the reset period, and a full-surface write discharge by application of the full-surface write pulse is done in each subfield. For this reason, each subfield emits light in the reset period not originally contributing to the video display, which decreases the video display contrast.

To solve this problem, the present applicant has invented and filed a driving method that realizes high contrast by decreasing the number of full-surface write discharges per frame (Japanese Patent Application Laid-Open No. 313598/1993). According to this driving method, the full-surface write discharge in the reset period is executed in only part of subfields in one frame, and only erase discharges in the reset period are executed in the remaining subfields.

In this high-contrast driving method, an erase discharge is performed in the reset period of the next subfield SFn+1 immediately after the sustain discharge (sustain) period of the n-th subfield SFn, as shown in FIG. 4. In this case, an erase pulse made of a small-width pulse (e.g., a pulse width of 2 $\mu$s or less) is applied to the common electrode X to erase wall charges of each electrode only from the cell which was turned on in the preceding subfield SFn.

An allowable range (voltage range from the minimum value to the maximum value will be called a driving voltage margin) is defined for the voltage values of various pulses for realizing driving of normally turning an ON cell on based on display data while keeping an OFF cell off. If the discharge starts unexpectedly early owing to nonuniform pixels and temperature condition changes in the small-width erase discharge during the reset period, a necessary wall charge erase fails. In addition, wall charges opposite in polarity to wall charges before an erase may be generated on the common electrode X and scanning electrode Y. This narrows the driving voltage margin.

To solve this problem, the present applicant has further invented and filed a new driving method (U.S. patent application Ser. No. 115911 filed on Jul. 15, 1998). According to this driving method, after a small-width pulse is applied during the reset period, another erase pulse (Slope Erase Pulse: SEP) which rises with a gradual slope is applied to make an erroneous erase state come close to a more complete erase state.

FIG. 5 shows an example of this driving method. FIG. 5 is a driving waveform chart showing part of the reset period in a given subfield. In an ON cell in which the final sustain discharge was done in a preceding subfield, positive and negative charges are respectively accumulated in the common electrode X and scanning electrode Y. In this state, an erase pulse of the voltage Vs made of a small-width pulse is applied to the common electrode X to erase wall charges of the ON cell, as shown in FIG. 5.

Note that the small-width pulse terminates application of the pulse voltage immediately after a discharge. Most of charge particles generated by the discharge are left in the discharge cell space, attracted by an electrostatic attraction to wall charges of the dielectric layer of the panel, and recombine each other and disappear on the wall surface. Such a strong discharge using a rectangular wave, however, may generate new wall charges opposite in polarity to wall charges before an erase, in the common electrode X and scanning electrode Y, as described above.

To prevent this, after an erase discharge using the small-width pulse is performed, an erase pulse (to be referred to as a positive obtuse wave) which rises to the voltage Vs with a gradual slope and an erase pulse (to be referred to as a negative obtuse wave) which falls to a voltage −Vy with a gradual slope are sequentially applied. Wall charges having an inverted polarity which are left owing to an excessive reaction with the small-width pulse, and wall charges which cannot completely be erased by the erase discharge using the small-width pulse are reacted and erased with the potentials of the positive and negative obtuse waves which gradually change with time.

More specifically, the amount of wall charges accumulated in a cell which was turned on in the preceding subfield is not always the same in all cells, so the discharge start voltage of each cell varies. If such obtuse waves are applied in this state, discharges sequentially occur from cells in which the pulse voltage during the rise of the positive obtuse wave and the fall of the negative obtuse wave reaches the discharge voltage. Each cell substantially receives the optimum voltage (voltage almost equal to the discharge start voltage). This can erase the residual charges.

In this related art, however, the erase discharge is done only for the cell, which was turned on in the preceding subfield among subfields except for a specific subfield in the high-contrast driving method. Under the influence of wall charges accumulated in the ON cell, charges may be accumulated in an OFF cell, which has been kept off, may not be erased, and may be left. FIGS. 6A to 6C are representations for respectively illustrating the states of charges accumulated in the OFF cell.

As shown in FIG. 6A, in an ON cell in which the final sustain discharge was done in the preceding subfield, positive charges are accumulated in its address electrode A and common electrode X, and negative charges are accumulated in its scanning electrode Y. Even in an OFF cell adjacent to the ON cell, weak positive wall charges are accumulated in its address electrode A and scanning electrode Y of the OFF cell, and weak negative wall charges are accumulated in its common electrode X under the influence of the wall charges accumulated in the ON cell.

If an erase discharge using the small-width pulse is executed in this state during the reset period of the next subfield, new wall charges opposite in polarity to the wall charges before being erased may be generated on the common electrode X and scanning electrode Y, as shown in FIG. 6B. If the erase discharge using the obtuse wave as shown in FIG. 5 is executed, wall charges accumulated in the ON cell are erased to be free from any residual charges, as shown in FIG. 6C.

The ON cell accumulates charges enough for satisfactorily starting discharging by the pulse voltage during the rise of the positive obtuse wave and the fall of the negative obtuse wave. By applying these positive and negative obtuse waves, the discharge can occur to erase residual charges. In the OFF cell, however, wall charges accumulated under the influence of the adjacent ON cell are weak. Even if the pulse voltage of the obtuse wave changes to the voltage Vs or −Vy, the OFF cell cannot reach the discharge start voltage, so wall charges cannot be erased and are left.

In this case, if the cell is kept off for several frames, like a still image and the background of a moving picture, the amount of residual charges accumulated in the OFF cell increases gradually. If a sufficient amount of residual charges, which cannot react with respect to the positive and negative obtuse waves, is accumulated in the OFF cell, the OFF cell which should not be turned on is turned on under the influence of residual charges to narrow the driving voltage margin.

FIG. 7 is a representation for illustrating this conventional problem. As shown in FIG. 7, a scan pulse of −Vy level is applied to scanning electrodes Yi and Yi+2 of cells C1 and C3 to be turned on in accordance with display data. At the same time, an address pulse of Va level is selectively applied to an address electrode A corresponding to the cells to be turned on, so as to emit light from the cells.

But, if a sufficient amount of residual charges is accumulated in an OFF cell C2 not to be turned on, an address pulse is applied owing to positive charges on the address electrode A to operate the cell C2 as if a scan pulse is applied owing to negative charges on a scanning electrode Yi+1. This causes a miss discharge in the OFF cell to generate wall charges. A sustain discharge is undesirably done in the OFF cell during the subsequent sustain discharge period to turn on the OFF cell though it should not be turned on.

SUMMARY OF THE INVENTION

The present invention has been made to overcome the conventional drawbacks, and aims to improve the driving voltage margin in driving a PDP, and reliably to realize driving of normally turning on an ON cell that should be turned on based on display data while keeping an OFF cell off.

To achieve the above object, in a plasma display driving method according to the present invention, each frame comprises subfields; each of the subfields includes a reset period for performing an erase discharge to make a wall charge distribution in each cell uniform, an address period for generating wall charges in a cell to be turned on in accordance with display data, and a sustain discharge period for discharging the wall charges accumulated in the cell during the address period, to emit light; and the reset period includes first and second erase discharge periods for performing erase discharges for cells having been turned on and not having been turned on, respectively.

The present invention can apply to a so-called high-contrast driving method. In this case, erase discharges done separately in the first and second erase discharge periods are executed in subfields except for a specific subfield.

A plasma display driving apparatus according to the present invention is for driving a plasma display panel in each of the subfields constituting one frame. Each of the subfields includes a reset period for performing an erase discharge to make a wall charge distribution in each cell uniform, an address period for generating wall charges in a cell to be turned on in accordance with display data, and a sustain discharge period for discharging the wall charges accumulated in the cell during the address period, to emit light. The apparatus comprises control means for performing erase discharges for cells having been turned on and not having been turned on, in first and second erase discharge periods in the reset period, respectively.

According to the present invention having the above features, during the reset period after the sustain discharge period, an erase discharge is done in the first erase discharge period for an ON cell turned on in the preceding sustain discharge period, so as to erase wall charges in the ON cell, for example. Even for an OFF cell not turned on in the preceding sustain discharge period, an erase discharge is done in the second erase discharge period on the basis of a pulse voltage having a different waveform from that for the ON cell. As a result, even weak wall charges accumulated in the OFF cell under the influence of the ON cell can be erased.

For example, the erase discharge for the OFF cell is achieved by applying to the first electrode the first erase pulse whose application voltage continuously changes with time in a positive direction, and applying to the second electrode the second erase pulse whose application voltage continuously changes with time in a negative direction. This can widen the potential difference between the first and second electrodes to erase even weak wall charges accumulated in the OFF cell under the influence of the ON cell.

In other words, the present invention performs erase discharges for ON and OFF cells in the first and second erase discharge periods in the reset period, respectively. Weak wall charges that could not completely be erased in the first erase discharge period, i.e., weak wall charges accumulated in the OFF cell under the influence of the ON cell can be erased in the second erase discharge period. This makes it possible to prevent an ON operation of the OFF cell that should not be turned on in the subsequent address period and sustain discharge period, and to improve the driving voltage margin.

BRIEF DESCRIPTION OF THE DRAWINGS

FIGS. 6A to 6C are representations for illustrating the respective states of wall charges accumulated in electrodes at the end of a sustain discharge and during a reset period when the AC driving type PDP driving method of FIG. 5 is applied, in which FIG. 6A shows the state at the end of a sustain discharge of the preceding subfield, FIG. 6B shows the state in the reset period of the next subfield, and FIG. 6C shows the state after an erase discharge;

FIGS. 12A to 12D are representations for illustrating the respective states of wall charges accumulated in electrodes when the AC driving type PDP driving method according to the embodiment is applied, in which FIG. 12A shows the state at the end of a sustain discharge of the preceding subfield, FIG. 12B shows the state in the reset period of the next subfield. FIG. 12C shows the state in the first erase discharge period, and FIG. 12D shows the state in the second erase discharge period;

DETAILED DESCRIPTION OF THE PREFERRED EMBODIMENTS

A preferred embodiment of the present invention will be described below with reference to the accompanying drawings.

In this embodiment, the present invention applies to a high-contrast driving method. In subfields except for a specific subfield (e.g., the first subfield in each frame), an erase discharge is only done in the reset period without performing any full-surface write discharge.

Figure 1:
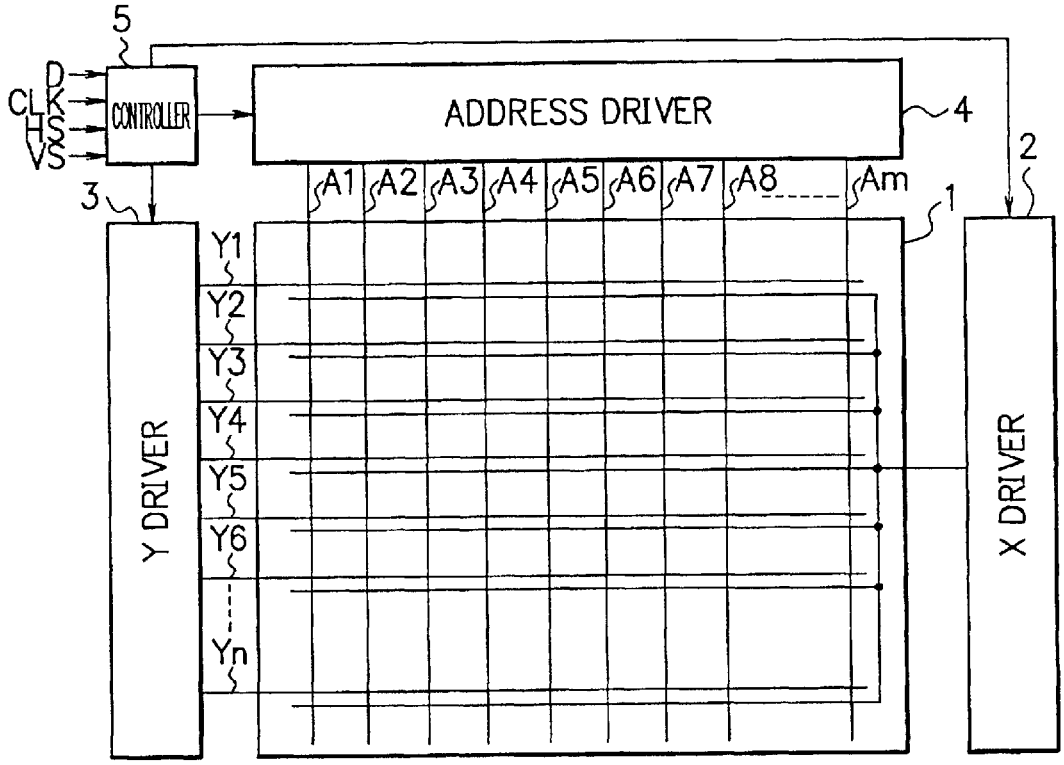
FIG. 1 is a circuit diagram showing the whole arrangement of an AC driving type plasma display panel apparatus.
Figure 2:
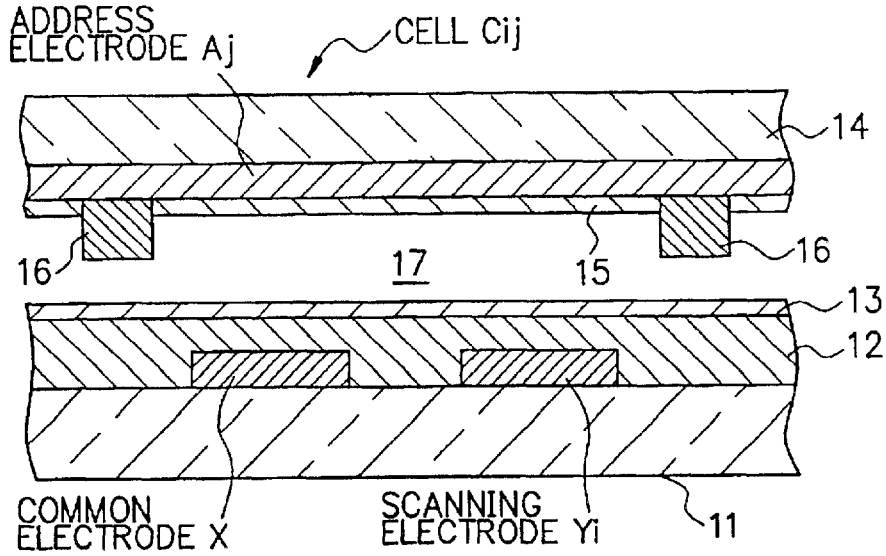
FIG. 2 is a sectional view showing the structure of a cell Cij as one pixel on the i-th row and j-th column.
Figure 3:
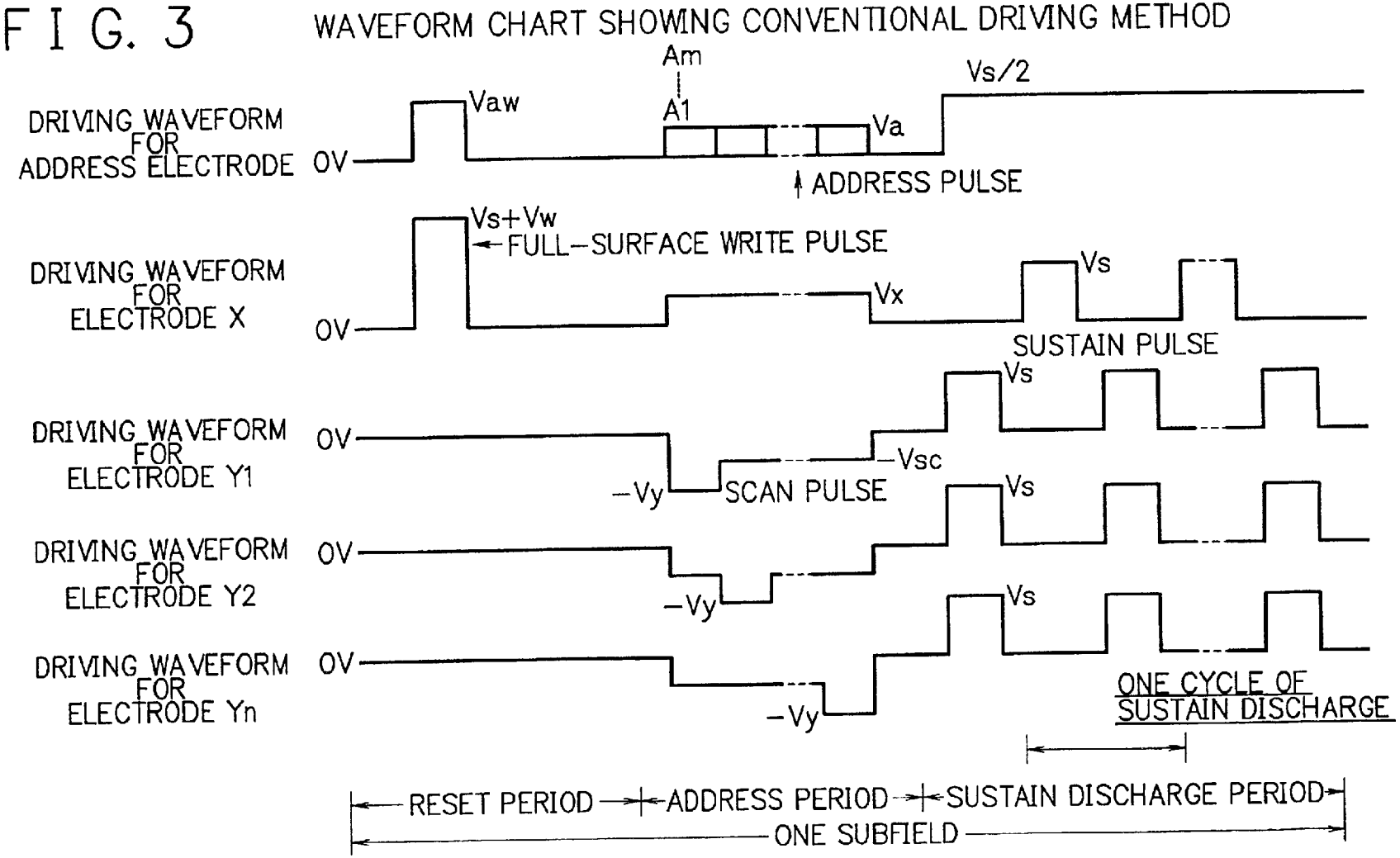
FIG. 3 is a waveform chart showing an example of a conventional AC driving type PDP driving method.
Figure 4:
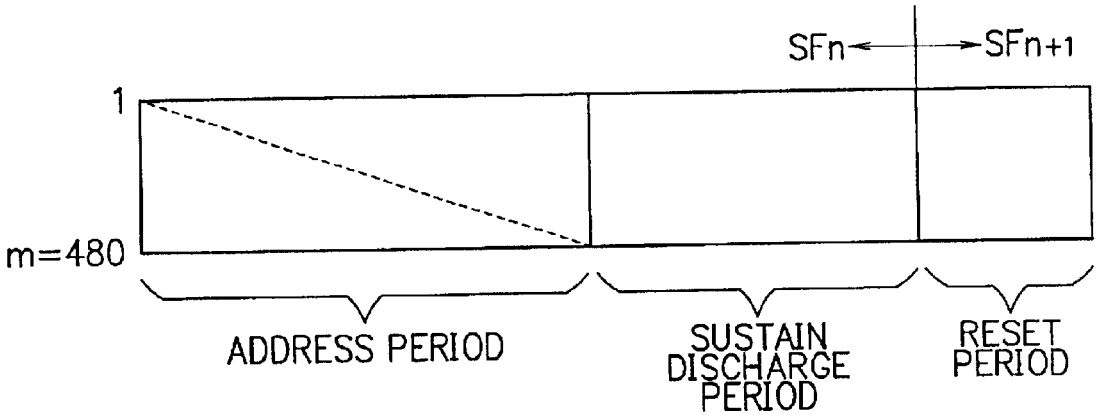
FIG. 4 is a representation of the structure of a subfield for use in explaining the conventional AC driving type PDP driving method.
Figure 5:
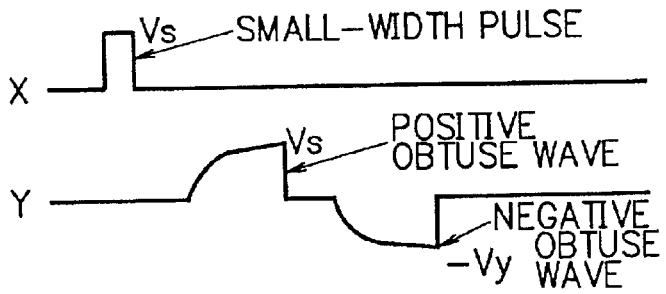
FIG. 5 is a waveform chart showing an example of the AC driving type PDP driving method.
Figure 8:
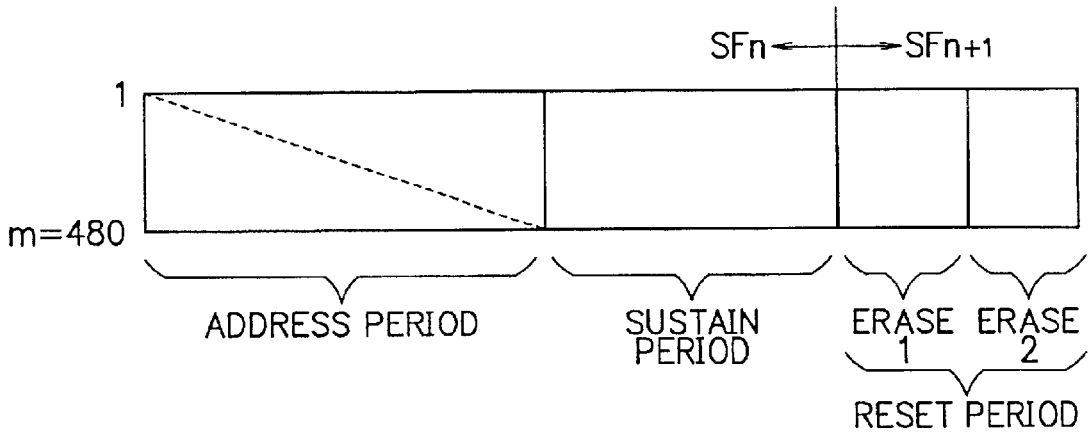
FIG. 8 is a representation of the structure of a subfield for use in explaining an AC driving type PDP driving method according to an embodiment of the present invention.

FIGS. 1 and 2 show the whole arrangement of an AC driving type PDP apparatus and the sectional structure of one cell according to this embodiment, respectively. Control means according to the present invention comprises a controller 5 in FIG. 1. FIG. 8 is a representation of the structure of a subfield for used in explaining a PDP driving method according to this embodiment.

In this embodiment, each subfield is divided into a reset period, an address period, and a sustain discharge (sustain) period. The reset period is further divided into the first erase discharge period in which an erase discharge is done for the cell which was turned on in the sustain discharge period of a preceding subfield, and the second erase discharge period in which an erase discharge of wall charges accumulated in an OFF cell under the influence of an adjacent ON cell is done even for the cell which was not turned on in the sustain discharge period of the preceding subfield.

In the first and second erase discharge periods, the residual charges in the ON and OFF cells are respectively erased by different application waveforms. In the first erase discharge period, a small-width pulse is applied to a common electrode X, and then an erase pulse (to be referred to as the first positive obtuse wave) which gradually rises to a voltage Vs with a gradual slope is applied to a scanning electrode Y. Wall charges accumulated in the ON cell by a sustain discharge in the preceding subfield are thereby erased by an erase discharge.

In the second erase discharge period, an erase pulse (corresponding to the first erase pulse in the present invention; to be referred to as the second positive obtuse wave) which gradually rises to a voltage Vax with a gradual slope is applied to the common electrode X (first electrode in the present invention). In addition, an erase pulse (corresponding to the second erase pulse in the present invention; to be referred to as a negative obtuse wave) which gradually falls to a voltage −Vy with a gradual slope is applied to the scanning electrode Y (second electrode in the present invention). As a result, wall charges left in the OFF cell under the influence of an adjacent ON cell are erased by an erase discharge.

Figure 9:
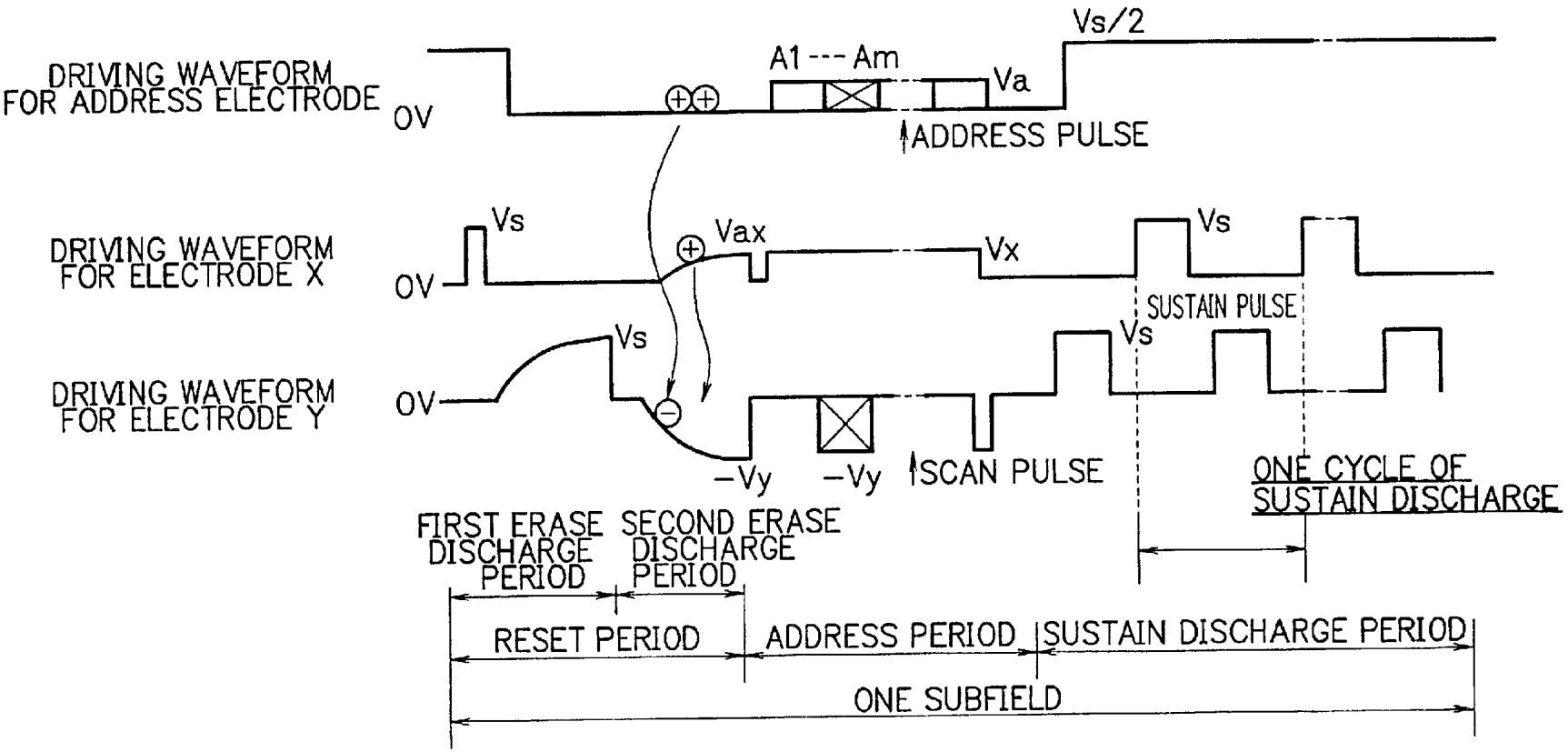
FIG. 9 is a waveform chart showing an example of driving waveform in an AC driving type PDP according to the embodiment.

FIG. 9 is a waveform chart showing an example of the driving waveform of the AC driving type PDP according to this embodiment, and shows one subfield except for a specific subfield in the high-contrast driving method.

As described above, in the first erase discharge period, the scanning electrode Y changes to ground level (0 V). At the same time, a small-width pulse of the voltage Vs (about 180 V) is applied to the common electrode X to erase wall charges in the ON cell. After the erase discharge using this small-width pulse, the first positive obtuse wave which gradually rises to the voltage Vs with a gradual slope is applied to the scanning electrode Y to erase wall charges having an inverted polarity which are left owing to an excessive reaction with the small-width pulse, and wall charges which cannot completely be erased by the erase discharge using the small-width pulse.

In the second erase discharge period, the negative obtuse wave which gradually falls to the voltage −Vy (about −150 V) with a gradual slope is applied to the scanning electrode Y. At the same time, the second positive obtuse wave, which gradually rises to the voltage Vax with a gradual slope, is applied to the common electrode X. By applying the second positive obtuse wave to the common electrode X in synchronism with application of the negative obtuse wave to the scanning electrode Y, the voltage difference between the electrodes X and Y can be widened to erase even weak wall charges left in the OFF cell by the erase discharge.

In this manner, the residual charges in the OFF cell can be erased before the address period. When an address pulse is selectively applied to an address electrode A on the basis of display data in the subsequent address period, and a scan pulse is applied to the scanning electrode Y to perform address discharges line-sequentially, any miss discharge on the OFF cell can be prevented. Consequently, in the subsequent sustain discharge period, the OFF cell which should not be turned on can be prevented from being turned on by the sustain discharge in the OFF cell.

The application timing of the second positive obtuse wave is the same as the application timing of the negative obtuse wave, for example. The pulse widths (rise time and fall time) of the second positive obtuse wave and negative obtuse wave have time widths enough for satisfactorily reaching the ultimate voltages Vax and −Vy at the resistances of circuits for generating these obtuse waves. If the slope of the obtuse wave is steep, the executed erase discharge may become strong. To prevent this, the resistance values of the circuits for generating the second positive obtuse wave and negative obtuse wave are respectively set so as to change these obtuse waves gradually. To allow each obtuse wave to reach a necessary voltage even at such resistances, the rise/fall time is set to, e.g., 100 $\mu$sec or more.

The final ultimate voltage Vax of the second positive obtuse wave is set such that the potential difference from the ultimate voltage −Vy of the negative obtuse wave is around the discharge start voltage (voltage at which a discharge occurs regardless of the presence/absence of wall charges) between the electrodes X and Y and is lower than this discharge start voltage. This is because a full discharge occurs if the voltage difference between the electrodes X and Y is equal to or larger than the discharge start voltage.

Figure 10A:
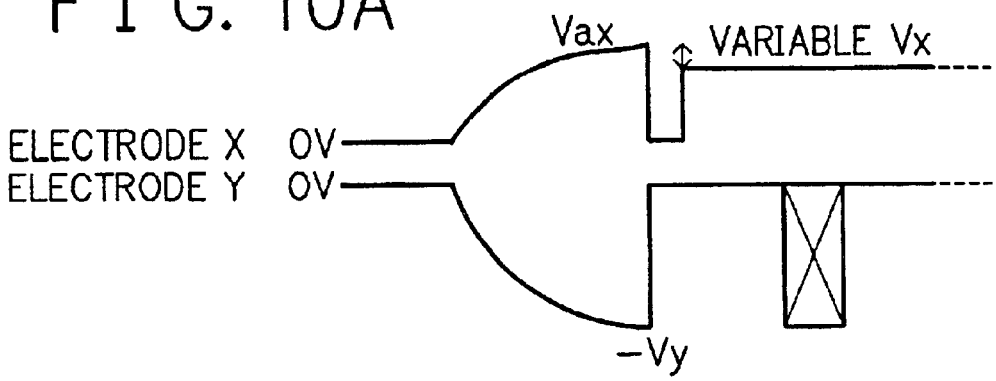
FIGS. 10A and 10B are waveform charts each showing a variable ultimate voltage Vax of a second positive obtuse wave.
Figure 10B:
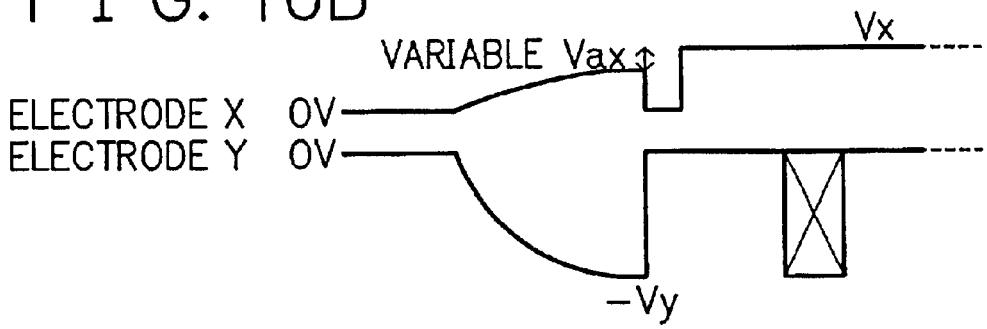
Figure 11:
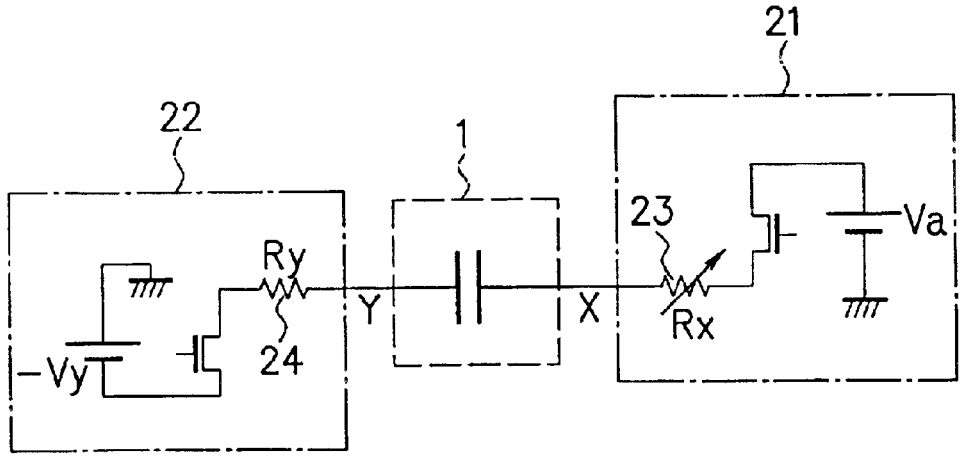
FIG. 11 is a circuit diagram showing an example of hardware arrangement for realizing the variable ultimate voltage Vax of the second positive obtuse wave.

The potential difference between the ultimate voltage Vax of the second positive obtuse wave applied to the common electrode X and the ultimate voltage −Vy of the negative obtuse wave applied to the scanning voltage Y is adjusted around the discharge start voltage. For this purpose, this embodiment can increase/decrease the value of the ultimate voltage Vax of the second positive obtuse wave, as shown in FIGS. 10A and 10B. FIG. 11 shows an example of an arrangement for attaining the purpose. FIG. 11 shows part of the AC driving type PDP apparatus shown in FIG. 1, and shows voltage setting means of the present invention.

In FIG. 11, a positive obtuse wave generator 21 is for generating the second positive obtuse wave. A negative obtuse wave generator 22 is for generating the negative obtuse wave. The positive and negative obtuse wave generators 21 and 22 are respectively incorporated in the X driver 2 and Y driver 3 shown in FIG. 1. The positive and negative obtuse wave generators 21 and 22 are connected to the common electrode X and scanning electrode Y of the AC driving type PDP 1, respectively.

The positive obtuse wave generator 21 comprises a resistor 23 for determining the rise slope of the second positive obtuse wave. The negative obtuse wave generator 22 comprises a resistor 24 for determining the fall slope of the negative obtuse wave. In this embodiment, the resistor 23 for the second positive obtuse wave is variable so as to increase/decrease a resistance value Rx and increase/decrease the value of the ultimate voltage Vax of the second positive obtuse wave. Note that the resistor 24 in the negative obtuse wave generator 22 may also be variable so as to increase/decrease a resistance value Ry.

The negative obtuse wave and second positive obtuse wave have the same application start timing, whereas the resistance values Rx and Ry cannot take the same value because of different final ultimate voltages. If the second positive obtuse wave rises too steeply, residual charges excessively react; if the second positive obtuse wave rises too slowly, the wave does not reach a desired voltage. Considering them, the resistance value Rx for the second positive obtuse wave must be optimized.

Figure 6A:
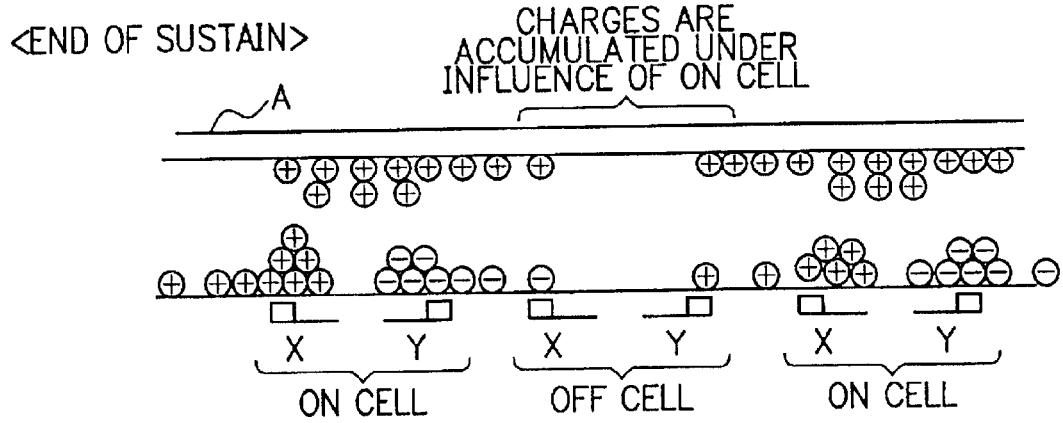
Figure 6B:
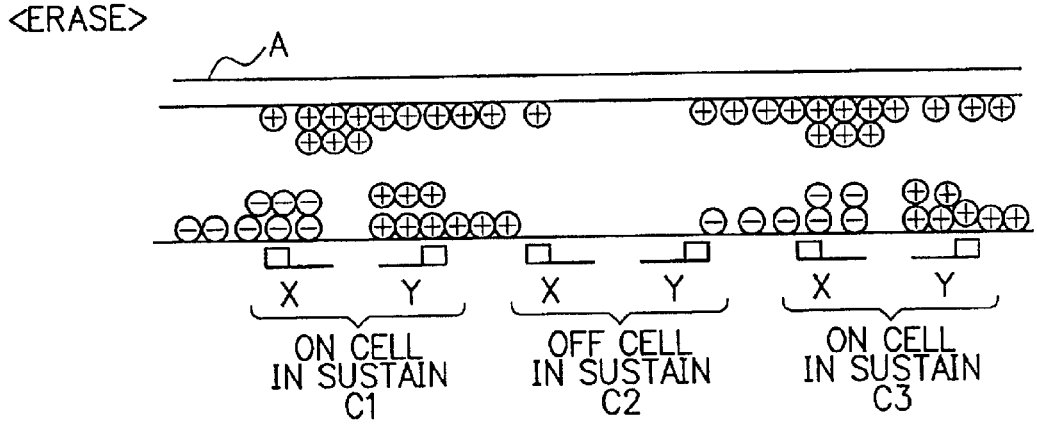
Figure 6C:
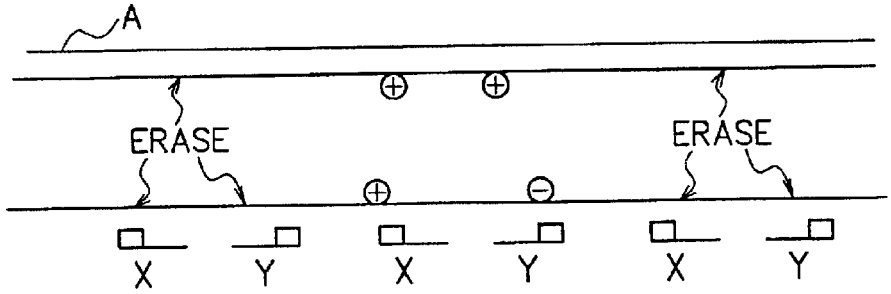
Figure 7:
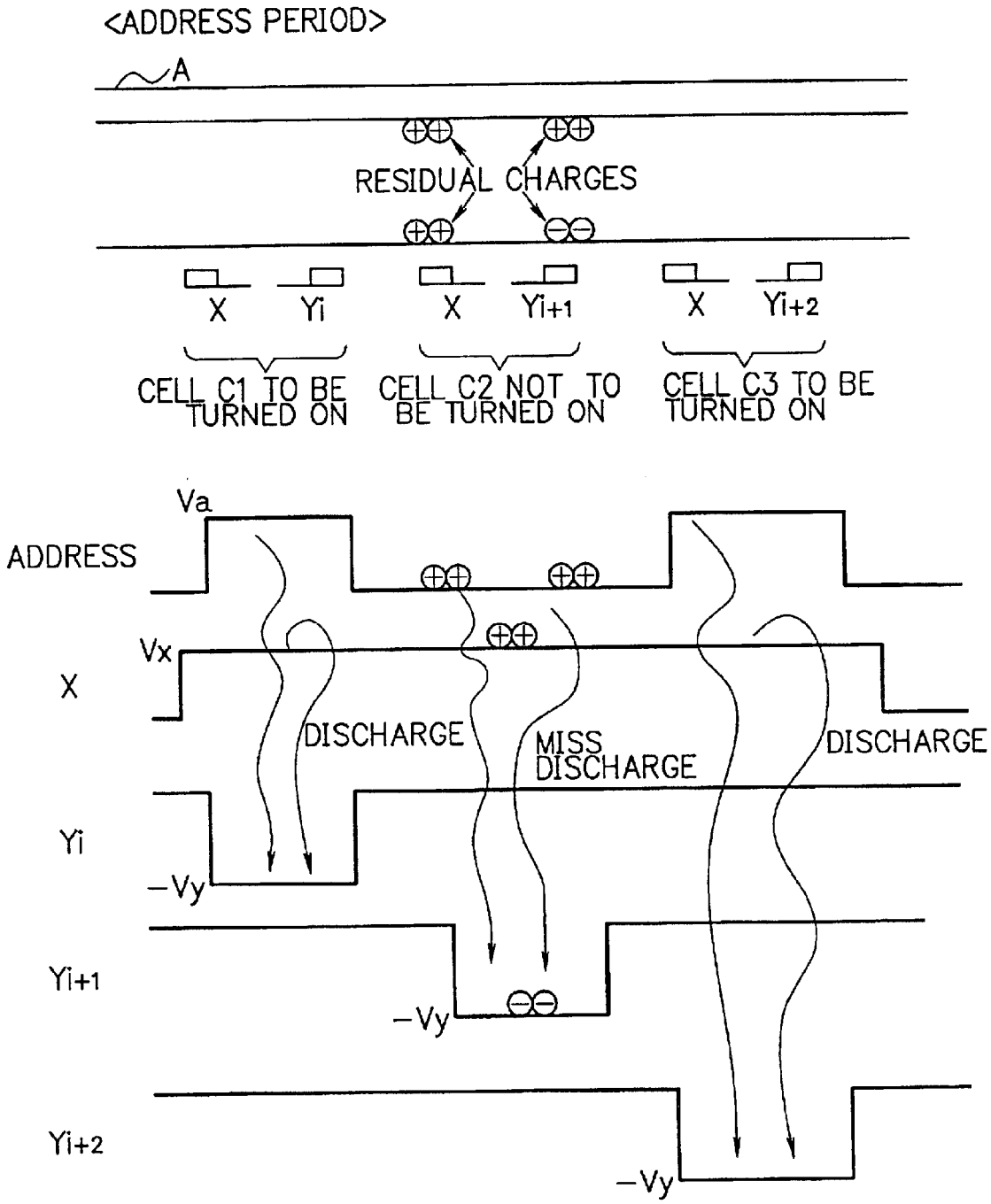
FIG. 7 is a representation for illustrating problems when the AC driving type PDP driving method of FIG. 5 is applied.

FIGS. 12A to 12D are representations for illustrating the respective states of wall charges accumulated in the address electrode A, common electrode X, and scanning electrode Y when the PDP driving method according to this embodiment is applied. The charge accumulation states shown in FIGS. 12A to 12C correspond to the states shown in FIGS. 6A to 6C, respectively. That is, wall charges accumulated in the ON cell at the end of the sustain discharge period are erased by applying the small-width pulse and first positive obtuse wave in the first erase discharge period, and applying the negative obtuse wave in the second erase discharge period.

Figure 12A:
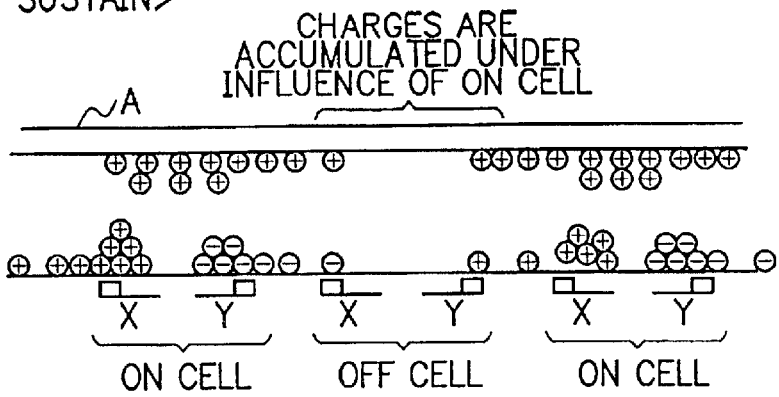
Figure 12B:
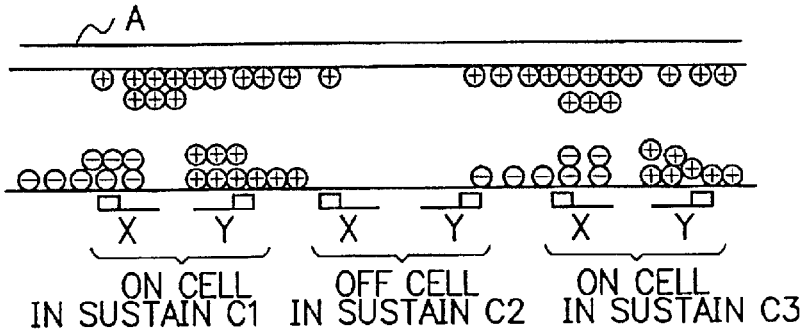
Figure 12C:
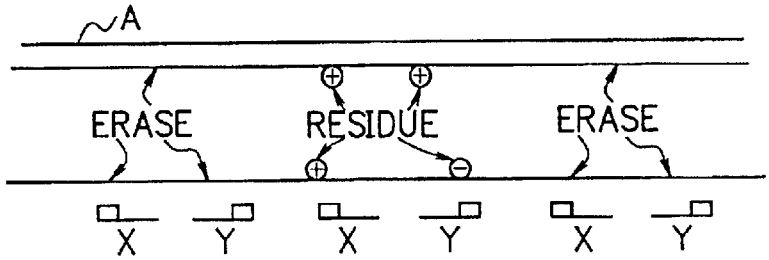
Figure 12D:
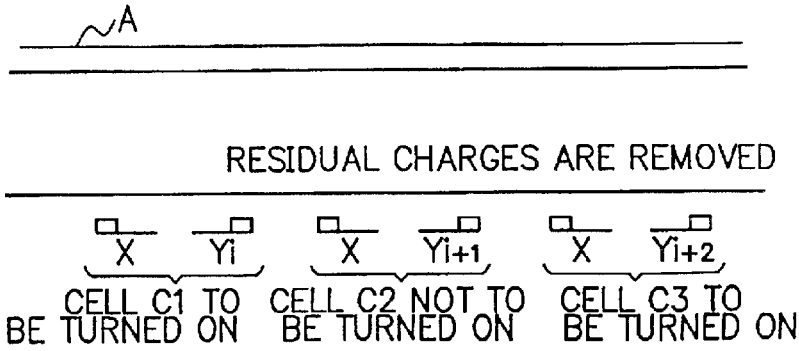

In addition, in this embodiment, the second positive obtuse wave is applied in synchronism with application of the negative obtuse wave in the second erase discharge period, so as to erase even weak residual charges accumulated in the OFF cell under the influence of the ON cell, as shown in FIG. 12D. This can prevent an ON operation of the OFF cell that should not be turned on in the subsequent address period and sustain discharge period, and can improve the driving voltage margin.

Figure 13:
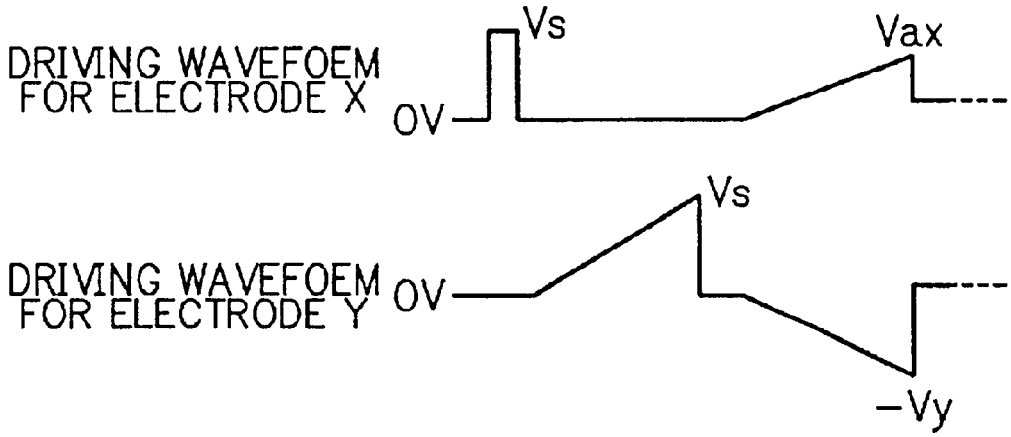
FIG. 13 is a waveform chart showing another example of driving waveform of the AC driving type PDP according to the embodiment.

In the above embodiment, an obtuse wave whose change rate per unit time gradually changes is applied as an erase pulse whose application voltage gradually changes with time, to the common electrode X and scanning electrode Y in the reset period. But, the present invention is not limited to this. For example, a triangular wave whose application voltage gradually changes at a constant change rate per unit time may be applied, as shown in FIG. 13.

Figure 14:
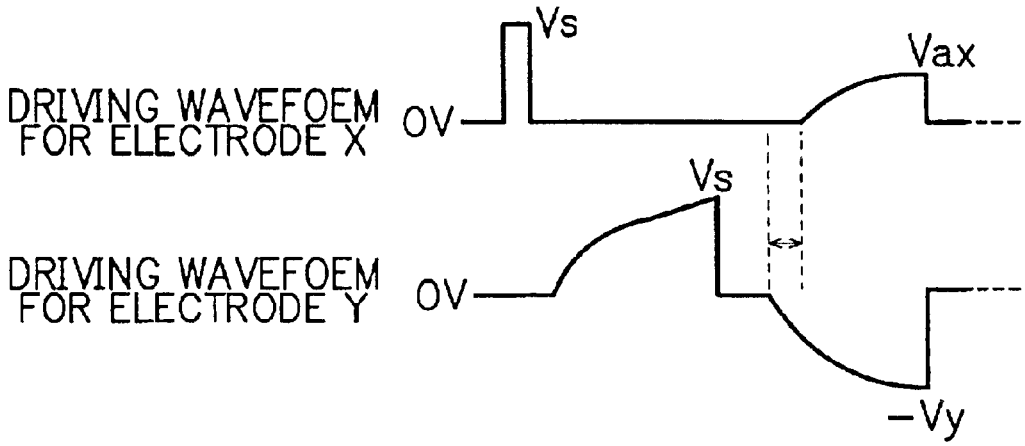
FIG. 14 is a timing chart showing another example of rise timing of the second positive obtuse wave applied in the embodiment.

In this embodiment, the rise start timing of the second positive obtuse wave and the fall start timing of the negative obtuse wave are synchronized. But, the present invention is not limited to this. For example, the rise start timing of the second positive obtuse wave applied to the common electrode X may be delayed from the fall start timing of the negative obtuse wave applied to the scanning electrode Y, so as to narrow the pulse width of the second positive obtuse wave, as shown in FIG. 14.

In this embodiment, the positive obtuse wave that rises in a positive direction is applied as an obtuse wave applied to the common electrode X in synchronism with the negative obtuse wave to the scanning electrode Y. Alternatively, a negative obtuse wave that falls in a negative direction may be applied to the common electrode X in synchronism with the first positive obtuse wave to the scanning electrode Y. But, the alternative method can be taken only when a time margin (e.g., an interval of 10 $\mu$sec or more) is set between the fall of the small-width pulse and application of the negative obtuse wave. This is because an erase may undesirably be done in an unstable charge state if the interval between the small-width pulse and negative obtuse wave is less than 10 $\mu$sec.

This embodiment has exemplified the high-contrast driving method. That is, a full-surface write and full-surface erase are performed during the reset period in the first subfield of each frame, and the above-described driving method is executed in the second and subsequent subfields. But, the principle of this embodiment is not limited to the high-contrast driving method.

For example, when full-surface write/small-width erase discharges are executed in the reset periods of all subfields, the same driving method as in this embodiment can apply to each of the subfields to produce the same effects as in the embodiment. Even when small-width erase discharges are done in the reset periods of all subfields without performing full-surface write discharges, the present invention is effective.

What is claimed is:

1. A plasma display driving method wherein:

each frame comprises plural subfields, each of said subfields including a reset period performing an erase discharge to initialize a wall charge distribution in each cell, an address period generating a wall charge distribution in accordance with display data, and a sustain discharge period discharging in accordance with the wall charge distribution generated in the cell during said address period, to emit light; and said reset period includes first and second erase discharge periods performing erase discharges to erase wall charges accumulated in cells wherein the erase discharge in said second erase discharge period is achieved by applying, to a first electrode, a first erase pulse whose application voltage continuously changes with time in a positive direction and applying, to a second electrode, a second erase pulse whose application voltage continuously changes with time in a negative direction.

2. A method according to claim 1, wherein:

a full-surface write discharge and a full-surface erase discharge are performed during said reset period only in a specific subfield among the plural subfields in each frame;

erase discharges to erase wall charges accumulated in cells are performed during said reset periods in the remaining subfields without performing said full-surface write discharges; and the erase discharges performed separately in said first and second erase discharge periods are executed in each subfield except for said specific subfield.

3. A method according to claim 1, wherein pulse widths of said first and second erase pulses have time widths required to reach ultimate voltages of said first and second erase pulses.

4. A method according to claim 1, wherein said first and second erase pulses have waveforms whose change rates, per unit time of the application voltage, change with time.

5. A method according to claim 1, wherein said first and second erase pulses have waveforms whose change rates, per unit time of the application voltage are constant.

6. A method according to claim 1, wherein a potential difference, between the respective ultimate voltages of said first and second erase pulses, is approximately the same as a discharge start voltage, between said first and second electrodes, and is smaller than said discharge start voltage.

7. A method according to claim 6, wherein at least one of said ultimate voltages of said first and second erase pulses is variable.

8. A method according to claim 1, wherein the rise start timing of said first erase pulse is synchronized with, or delayed from, the fall start timing of said second erase pulse.

9. A plasma display driving apparatus driving a plasma display panel wherein, in each of plural subfields constituting one frame, each of said subfields includes a reset period performing an erase discharge to initialize a wall charge distribution in each cell, an address period generating a wall charge distribution in accordance with display data, and a sustain discharge period discharging each cell in accordance with the wall charge distribution generated in the cell during said address period, to emit light, said apparatus comprising:

a controller performing erase discharges for cells in first and second erase discharge periods in said reset period;

wherein said controller performs the erase discharge in said second erase discharge period to erase wall charges accumulated in cells by applying, to a first electrode, a first erase pulse whose application voltage continuously changes with time in a positive direction and applying, to a second electrode, a second erase pulse whose application voltage continuously changes with time in a negative direction.

10. An apparatus according to claim 9, wherein:

said controller performs a full-surface write discharge and a full-surface erase discharges during said reset period only in a specific subfield among the plural subfields in each frame, erase discharges to erase wall charges accumulated in cells during said reset periods in the remaining subfields without performing said full-surface write discharges, and executes the erase discharges, performed separately in said first and second erase discharge periods in each subfield except for said specific subfield.

11. An apparatus according to claim 9, wherein said controller applies, as said first and second erase pulses, pulse voltages having waveforms whose change rates, per unit time of the application voltage, change with time.

12. An apparatus according to claim 9, further comprising a voltage setting unit setting a potential difference, between the respective ultimate voltages of said first and second erase pulses, to be approximately the same as a discharge start voltage, between said first and second electrodes, and to be smaller than said discharge start voltage.

13. An apparatus according, to claim 12, wherein said voltage setting unit selectively changes at least one of the respective ultimate voltages of said first and second erase pulses.

14. An apparatus according to claim 13, wherein said voltage setting unit comprises a first resistor in a pulse generation circuit generating said first erase pulse and a second resistor in a pulse generation circuit generating said second erase pulse, and at least one of said first and second resistors is variable.

15. An apparatus according to claim 14, wherein said first and second resistors have respective, different resistance values.

16. An apparatus according to claim 9, wherein said controller synchronizes or delays a rise start timing of said first erase pulse with, or from, a fall start timing of said second erase pulse.

* * * * *